US006263707B1

(12) United States Patent
Miller et al.

(10) Patent No.: US 6,263,707 B1
(45) Date of Patent: Jul. 24, 2001

(54) OPAQUE HEAT-MOLDABLE CIRCULAR KNIT SUPPORT FABRICS HAVING VERY HIGH SPANDEX CONTENT

(75) Inventors: James Martin Miller, Roebuck; Arlis Steven Hall, Spartanburg; Harry McCarter, Inman; Larry Stephens, Spartanburg, all of SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/400,512

(22) Filed: Sep. 20, 1999

(51) Int. Cl.[7] ..... D04B 9/06; D04B 1/02

(52) U.S. Cl. ..... 66/171; 66/172 E; 66/175; 66/202

(58) Field of Search ..... 264/292; 66/171, 66/172 E, 202, 175

(56) References Cited

U.S. PATENT DOCUMENTS

| | | | | |
|---|---|---|---|---|
| 2,946,211 | * | 7/1960 | Morancy | 66/200 |
| 3,377,249 | | 4/1968 | Marco | 8/115.6 |
| 3,513,668 | * | 5/1970 | Mintz | 66/193 |
| 3,540,835 | | 11/1970 | Marco | 8/115.6 |
| 3,563,795 | | 2/1971 | Williams et al. | 117/139.4 |
| 3,574,620 | | 4/1971 | Tesoro | 117/62.1 |
| 3,598,641 | | 8/1971 | Miller et al. | 117/138.8 E |
| 3,620,826 | | 11/1971 | Machell | 117/139.5 C |
| 3,625,754 | | 12/1971 | Dunn | 117/138.8 F |
| 3,632,420 | | 1/1972 | Kuhn | 117/138.8 F |
| 3,649,165 | | 3/1972 | Cotton | 8/115.5 |
| 3,650,801 | | 3/1972 | Hinton, Jr. et al. | 117/47 A |
| 3,652,212 | | 3/1972 | Machell | 8/115.5 |
| 3,660,010 | | 5/1972 | Georgoudis et al. | 8/115.6 |
| 3,676,052 | | 7/1972 | Harper, Jr. et al. | 8/115.6 |
| 3,690,942 | | 9/1972 | Vandermass et al. | 117/138.8 F |
| 3,814,107 | | 6/1974 | Greenblatt et al. | 128/480 |
| 3,897,206 | | 7/1975 | Kearney | 8/120 |
| 3,910,075 | | 10/1975 | Holliday | 66/192 |
| 3,956,906 | * | 5/1976 | Cassidy, Sr. | 66/42 |
| 3,981,807 | | 9/1976 | Raynolds | 252/8.8 |
| 4,014,857 | | 3/1977 | Schmoyer | 260/67.6 R |
| 4,068,035 | | 1/1978 | Violland et al. | 428/279 |
| 4,073,993 | | 2/1978 | Lark | 428/261 |
| 4,090,844 | | 5/1978 | Rowland | 8/120 |
| 4,131,550 | | 12/1978 | Marco | 252/8.6 |
| 4,164,392 | | 8/1979 | Hauser et al. | 8/18 R |
| 4,168,954 | | 9/1979 | Marco | 8/18 R |
| 4,207,071 | | 6/1980 | Lipowitz et al. | 8/115.6 |
| 4,217,905 | | 8/1980 | Atwater et al. | 128/498 |
| 4,290,765 | | 9/1981 | Sandler | 8/115.6 |
| 4,304,108 | * | 12/1981 | Chamlee | 66/139 |
| 4,375,445 | * | 3/1983 | Cole et al. | 145/93 |
| 4,427,557 | | 1/1984 | Stockburger | 252/8.7 |

(List continued on next page.)

*Primary Examiner*—Andy Falik
(74) *Attorney, Agent, or Firm*—Terry T. Moyer; William S. Parks

(57) ABSTRACT

A fabric and method to support garments comprising opaque heat-moldable circular knit fabrics having relatively high amounts of spandex material as well as sufficient amounts of other fibers to simultaneously provide maximum support and maximum comfort to a wearer and which can be easily molded to the specifications of a wearer's body dimensions. Such high-spandex content, moldable garment fabrics are novel to the industry since the permissible added amount of spandex within such fabrics has been limited due to the power, modulus strength, and elongation of such fibers. Furthermore, the ability to provide moldable, high-spandex circular knit fabrics has been limited, if not impossible, due to the above-noted characteristics of the spandex fibers themselves. The inventive moldable fabrics and garments provide such desirable spandex properties while also increasing the comfortability to the wearer. The method of producing such fabrics is also contemplated within this invention. Both the fabric and the method state that the amount of spandex in the fabric is at least 24% of the total fiber weight in the fabric.

13 Claims, 1 Drawing Sheet

U.S. PATENT DOCUMENTS

| | | | | |
|---|---|---|---|---|
| 4,467,595 | | 8/1984 | Kramers | 57/225 |
| 4,487,040 | | 12/1984 | Patel et al. | 66/195 |
| 4,551,277 | | 11/1985 | Patel | 28/166 |
| 4,937,277 | | 6/1990 | O'Lenick, Jr. | 524/318 |
| 4,998,419 | * | 3/1991 | Moore | 66/25 |
| 5,033,986 | | 7/1991 | Feigenbaum et al. | 450/30 |
| 5,359,732 | | 11/1994 | Waldman et al. | 2/67 |
| 5,385,502 | | 1/1995 | Moretz et al. | 450/93 |
| 5,441,436 | | 8/1995 | Moretz et al. | 450/93 |
| 5,826,273 | | 10/1998 | Eckes | 2/69 |

* cited by examiner

OPAQUE HEAT-MOLDABLE CIRCULAR KNIT SUPPORT FABRICS HAVING VERY HIGH SPANDEX CONTENT

FIELD OF THE INVENTION

This invention relates to support garments which comprise opaque heat-moldable circular knit fabrics having relatively high amounts of spandex material as well as sufficient amounts of other fibers to simultaneously provide maximum support and maximum comfort to a wearer and which can be easily molded to the specifications of a wearer's body dimensions. Such high-spandex content, moldable garment fabrics are novel to the industry since the permissible added amount of spandex within such fabrics has been limited due to the power, modulus strength, and elongation of such fibers. Furthermore, the ability to provide moldable, high-spandex circular knit fabrics has been limited, if not impossible, due to the above-noted characteristics of the spandex fibers themselves. Thus, the incorporation of such moldable fabrics within certain support garments (such as brassieres, girdles, medical braces, athletic supporters, and the like) has been unsuccessful in the past. The inventive moldable fabrics and garments provide such desirable spandex properties while also increasing the comfortability to the wearer. The method of producing such fabrics is also contemplated within this invention.

DISCUSSION OF THE PRIOR ART

Support garments have been utilized for centuries to provide methods of keeping body parts stationary (such as with knee braces), alleviating discomfort and/or making fashion statements (such as with brassieres, including sports bras), constraining certain areas of a person's body in order ultimately to provide an aesthetically pleasing figure (such as with girdles and the like), protecting particularly susceptible body parts from harm (such as with athletic supporters), and the like. Myriad ways of providing such methods have been developed in the past. For instance, braces have been produced which utilize high tensile strength/low elongation fibers, metal components, and cast materials. Brassieres and girdles have been fashioned from certain fabric configurations, metal wires, and, again, high tensile strength/low elongation fibers. Added padding and/or high tensile strength/low elongation fibers have been utilized to improve upon existing athletic supporter garments as well. In each of these examples, the improvements have focused on adding cumbersome and potentially uncomfortable metal wires or extra material within the body of the garment, utilizing high tensile strength fibers in high amounts, or utilizing strips of the garment fabric placed at specific angles, all in order to provide the requisite and desired support. Nor have these past garment and/or fabric developments have generally not been available as moldable articles which can be modified to conform to a wearer's body dimensions. As such, there is a need to produce a moldable fabric which provides the necessary level of support for such garments with a simultaneous increase in comfort for the wearer.

High modulus fibers, such as spandex, have been introduced in the past within woven and knit fabric constructions in order to provide increased power, elongation, and thus support within such garments. However, an increase in the amount of spandex has invariably reduced the comfort level due to the highly constrictive power of such high spandex-content fabrics. In particular, circular knit fabrics have been extremely difficult to create which comprise high amounts of spandex (greater than 24%) and which are sufficiently comfortable to the wearer. Circular knits are highly desirable as support garments and permit more efficient jet-dyeing procedures through the production of curl-susceptible (i.e., elastomeric fiber-containing) fabrics in tubular form. Jet dyeing provides a simplified and effective method of coloring fabrics quickly and evenly. Thus, in an effort to more efficiently produce such support garment fabrics, the ability to utilize jet dyeing techniques would reduce cost by more thoroughly and evenly coloring the target fabrics. Consistency in colorations for large amounts of fabrics would thus be more easily and inexpensively achieved. Warp-knit fabrics comprising curl-susceptible fibers are not produced in tubular form; instead they are formed as webs. Thus, in order to permit proper jet-dyeing of such fabrics, the edges of such webs must be attached by gluing, sewing, and the like, and subsequently split apart in order to properly permit jet-dyeing. Such a time-consuming and labor-intensive procedure is therefore unacceptable, particularly for curl-susceptible fabrics for which circular knit constructions are desired. Thus, there is a clear need to produce high spandex-content circular knit fabrics which can be jet-dyed in knitted tubular form. Such high spandex-content circular knit fabrics have heretofore been unexplored. Furthermore, circular knits are more easily stitched to conform with specific shapes and configurations in order to provide comfort to a wearer as well. Thus, circular knit fabrics which comprise large amounts of spandex are highly desirable within the industry; unfortunately, as noted above, the incorporation of such high amounts of spandex have proven too difficult to provide the desired comfort level and simultaneous support function. The prior art has not accorded the industry with any teaching to accomplish this desired task. As such, there is still a need to develop a circular knit fabric having a high spandex content (above 24% of the total weight of the fabric) which comprises other fibers to provide comfort to the wearer.

DESCRIPTION OF THE INVENTION

It is thus an object of the invention to provide such improved high-density (opaque) heat-moldable support for a wearer's body parts (such as an injured knee joint, a woman's breasts, and the like) within a garment through the utilization of a specific circular knit fabric comprising relatively high amounts of spandex fibers. A further object of the invention is to provide a comfortable, functional support garment made from circular knit fabrics of high spandex content. Another object is to provide a support garment which possesses suitable flexibility for placement on and around a target body part and provides excellent support upon placement at the target location. Still a further object of the invention is to provide a method for producing such a high spandex-content circular knit support garment fabric.

Accordingly, this invention encompasses an opaque heat-moldable circular knit fabric comprising at least two different types of fibers, wherein one type is spandex, wherein said spandex is present in an amount of at least 24% of the total weight of fabric, and wherein at least one non-spandex-containing float per repeated knit pattern is present within the knit fabric. Furthermore, this invention also concerns a method of forming an opaque heat-moldable, circular knit fabric comprising at least 24% of spandex yarns by weight of the fabric, said method comprising the steps of:

(a) providing at least one thread of spandex fiber;

(b) delivering said thread to a needle bed under constant tension;

(c) feeding said thread into a needle bed while simultaneously elongating said thread to at least 100% of its total stretch capability;

(d) introducing said elongated spandex thread within a carrier fabric comprising at least one fiber selected from the group consisting of polyamide, polyester, cotton, wool, ramie, acetate, polyurethane, and any blends thereof;

(e) pulling said spandex thread into the loop construction of said circular knit fabric; and (f) knitting at least one non-spandex-containing float per repeated knit pattern into the fabric structure. Further steps to produce a support garment comprising such an inventive fabric would include (g) incorporating the circular knit fabric into a garment (such as through sewing, adhering, and the like);

(h) fitting the support garment of step "g" to at least a portion of a person's body; and (i) heat-setting the garment in the position in which the garment is oriented during step "h". Nowhere within the prior art has such a specific fabric, support garment, or method of producing the same been disclosed or fairly suggested. There is no specific teaching or even implication, however, within the prior art concerning circular knit fabrics which comprise at least 24% spandex fibers. Nor is there any discussion of the problems inherent with introducing such a large amount of powerful spandex fibers within a circular knit construction, particularly when moldability, and consequently, comfort are the primary concerns for the wearer. Additionally, there is no teaching or fair suggestion within the prior art even remotely concerning any manner of fulfilling the need for high spandex fiber content in support garments, while simultaneously according the wearer heat-moldability and thus comfortability as well. The inventive circular knit fabrics utilized within such support garments contain such high spandex fiber content and provide concurrent comfort to the wearer. The introduction of high amounts of spandex within circular knits have not been possible without sacrificing comfort (and thus wearability). Circular knits, as discussed above, are highly desirable as support garments, permit more efficient jet-dyeing procedures as compared with other knit fabrics, and are more easily stitched to conform with specific shapes and configurations in order to provide maximum comfort to a wearer.

The closest prior art, U.S. Pat. No. 5,359,732 to Waldman et al., discusses the production of garments comprising potentially knit fabrics having a spandex content of at most 20%. However, there is no disclosure or fair suggestion that a circular knit construction is favored or even possible within patentees' fabrics. Furthermore, U.S. Pat. No. 4,467,595 to Kramers discloses the incorporation of spandex fibers within composite yarns. However, Kramers fails to teach, and actually diverges from, the same current inventive methods and fabrics since the ability to incorporate such spandex content cannot be achieved through elongation or constant, consistent tension application on all of the knit yarns. Lastly, there is no discussion of the potential for circular knit fabrics made from such composite yarns anywhere within Kramers teachings.

The term "support garment" is intended to encompass any textile utilized on a person's body for the purpose of providing support to, keeping stationary, and/or protecting a particular body part or parts. Included in this description are brassieres, most notably, but not limited to, sports bras; medical braces, such as for knees or elbows, as merely examples; support underwear, such as "control-top" panties and hosiery; and athletic supporters (i.e., jock straps). Again, this list merely describes preferred embodiments of the inventive support garment and by no means is intended to limit the scope of the invention.

At the very least, two different fibers must be present within the inventive fabric (any number of blends, other fibers, etc., may be present as well; the minimum number of fibers present is two). One must be spandex; however, the other may be of any type, as long as it is not spandex itself. Polyester and polyamide are most preferred; however, any natural fibers, such as cotton, ramie, and the like; any other synthetic fibers, such as polyurethanes, acrylics, and the like; and any blends thereof of any natural and/or synthetic fibers may be utilized within the inventive fabric, such as cotton/polyester and polyester/nylon blends. Of particular interest are fabrics which possess suitable weights for incorporation within flexible support garments. As merely examples, weights of fabric in the range of between 2.0 and 12.5 ounces per square yard are preferred with more preferred possessing weights of 3.5 to about 10.5 ounces per square yard. Also, the permissible deniers of such other fibers range from about 10 to about 1,000, with 20 to about 700 more preferable, and from about 70 to about 200 most preferable. Furthermore, synthetic fibers may be present in filament form in any count; however, counts ranging from about 1 to about 100 are preferred, 5 to about 80 more preferred, and from about 20 to about 70 most preferred.

One preferred type of spandex is available from DuPont under the tradename Lycra®; however, any type of spandex may be utilized within this inventive fabric. The range of permissible deniers for such fibers is from about 1 to about 1,000; preferably from about 5 to about 700; more preferably from about 50 to about 200; and most preferably from about 100 to about 140. One preferred type of spandex is that which may elongate, at the least, to about 100% of its relaxed length. Again, at least 24% by weight of the target fabric should constitute some form of spandex in order to provide the required power in the fabric (for the required support functions).

Any other standard textile additives, such as dyes, pigments, hydrophobic agents (i.e., fluorocarbons), sizing compounds, and softening agents may also be incorporated within or introduced onto the surface of the target fabric after or incorporated within the constituent fibers prior to production. Particularly desired as optional finishes to the inventive fabrics are soil release agents which improve the wettability and washability of the fabric. Preferred soil release agents include those which provide hydrophilicity to the surface of polyester. With such a modified surface, again, the fabric imparts improved comfort to a wearer by wicking moisture. The preferred soil release agents contemplated within this invention may be found in U.S. Pat. Nos. 3,377,249; 3,540,835; 3,563,795; 3,574,620; 3,598,641; 3,620,826; 3,632,420; 3,649,165; 3,650,801; 3,652,212; 3,660,010; 3,676,052; 3,690,942; 3,897,206; 3,981,807; 3,625,754; 4,014,857; 4,073,993; 4,090,844; 4,131,550; 4,164,392; 4,168,954; 4,207,071; 4,290,765; 4,068,035; 4,427,557; and 4,937,277. These patents are accordingly incorporated herein by reference. The inventive fabric preferably comprises such soil release agents in order to wick moisture from the wearer (as another way of providing comfort), particularly, and primarily when the constituent fibers are spandex and the preferred polyester.

Such an inventive fabric also provides the benefit of heat-moldability to the dimensions of a wearer. The yarns themselves will stretch to a certain orientation upon placement of the fabric into a garment and fitting the resultant garment to at least a portion of the body of a wearer. At that point, the fabric may then be heat-set to retain the specific body-dimension yarn orientation in order to provide continued and consistent comfortability for the wearer. The yarns, upon stretching, can thus be set into specific positions upon exposure to the temperature (which is highly dependent upon the type of fibers present; for example, if polyester or polyamide, such as nylon, is utilized, the heat-set temperature is from about 162 to about 210° C.) required to melt the constituent yarns into their most relaxed positions when stretched to the wearer's body dimensions, and then cooled, in order to retain the desired yarn and fabric orientation. This benefit is most pronounced when all synthetic yarns are knitted into the inventive fabric structure.

The desired and required degree of opacity possessed by the inventive fabric is provided by the addition of floats (i.e., yarns oriented transversely from the remaining stitch pattern) within the circular knit structure. These floats increase the density of the fabric and pervade discrete areas within the knitted fabric in which generally no fibers are present. By so doing, these floats provide cover to very small areas of the target fabric, and ultimately the target support garment, which would normally remain uncovered. Thus, the utilization of floats increases the opacity of the target fabric and substantially prevents the production of see-through fabrics. Such opacity is highly desirable in order to conceal a wearer's body parts from view. Additionally, such floats also act to increase the heat-moldability or heat-setting of the fabric to the contours and dimensions of at least a portion of a wearer's body structure as well as to provide increased opacity to the target fabric. This float adds strength to the fabric while also retaining the ability to be modified upon exposure to heat and thus to retain its molded orientation upon heat-setting. In such a manner, the different, individual floats within the target fabric orient themselves to different positions (lengths, stretches, directions, etc.) when fitted to a wearer's body. When subsequently exposed to sufficient heat for heat-molding, the floats remain in substantially the same position as the wearer requires for maximum comfort. As noted above, the other fibers, including the spandex components, will also become heat-set to a certain degree as well.

The important aspects of this invention lie first in the specific method utilized to incorporate the spandex fibers within the circular knit construction and second in the utilization of at least one float (of a fiber which is not spandex) within each repeating knit pattern of the target fabric. As noted above, the specific method entails keeping the tension on the spandex substantially constant during the delivery of the spandex thread (or yarn) to the needle bed of the circular knit machine. The thread (or yarn) is then elongated to at least 100% of its stretch capability while it is fed into the needle bed and threaded through a carrier fabric. The thread (or yarn) is then pulled into the loop construction of the fabric while still elongated. After knitting the fiber can then relax into original shape.

Such a procedure has not been practiced in order to produce relatively high spandex-content circular knit fabrics. The pre-elongation of the thread (or yarn) permits incorporation of the spandex fibers in high amounts within the target circular knit fabric without compromising the desired comfort offered to the wearer of the ultimate support garment. It is believed, without intending to be limited to such any scientific theory, that the prevention of the spandex thread (or yarn) from retaining its desired shape and length prior to knitting basically allows for the entire knitted fabric to relax simultaneously from the same consistent tension during knitting. As such, each relaxed thread or yarn retains its original, inherent shape, length, etc., to the same degree as the other threads or yarns of the knitted fabric. In the past, the difficulties in incorporating spandex within circular knits stem from the differences in the shapes of the fibers during knitting. A large number of threads having different configurations from the remaining fibers of the target knit structure affects the shape of the produced fabric, limits the effectiveness of the produced fabric, and compromises the integrity of the produced fabric. Thus, non-elongated spandex fibers, for example, would strain the knitting machine in an attempt to continue the desired pattern, thereby producing a fabric which had discrete areas of "power" which reduced the aesthetics of the produced fabric by "warping" the remaining fibers into random directions (such as puckering). Also, such puckering of fabric could facilitate unraveling of knitted fibers as well as provide difficulties in assessing the proper placement of fabrics within garments. Thus, the inventive method eliminates such problems by first elongating the spandex threads (or yarns) and subsequently knitting them into the desired circular knit structure. The fibers then relax into the same pattern as the other fibers within the target fabric, which, in turn, provides the basis for the production of powerful, heat-moldable, and comfortable circular knit high spandex-content support garments.

As one of ordinary skill in this art would appreciate, the continuous performance of such a specific knitting method is extremely difficult. The ability to provide knitting needles which can withstand and differentiate the differences in pressure between spandex fibers and others (such as polyesters, for example) while also elongating the spandex fibers to relatively large degrees, all while permitting a reproducible process for an appreciable amount of time is not a simple task. The inherent difficulties have most likely swayed artisans away from such a specific method in the past. However, if the proper stretching and knitting is performed, the results are the inventive fabrics which are very powerful and comfortable at the same time.

As noted above, this inventive fabric may be incorporated into any type of support garment since the high amounts of spandex provide the proper amount of stress and strain for the target fabric. The fabrics may be knit in different fashions in order to provide more power to discrete areas of the fabric depending on the type of support garment within which such fabric will be incorporated. As merely non-limiting examples, brassieres, including sports bras, braces, and athletic supporters are contemplated as support garments for the inventive fabrics.

While the invention will be described in connection with preferred embodiments and procedures, it is to be understood that the invention is in no way intended to be limited by such description. On the contrary, it is intended to cover all alternatives, modifications and equivalents as may be included within the true spirit and scope of the invention as defined by the claims appended hereto.

DETAILED DESCRIPTION OF THE DRAWINGS

Figure 1:
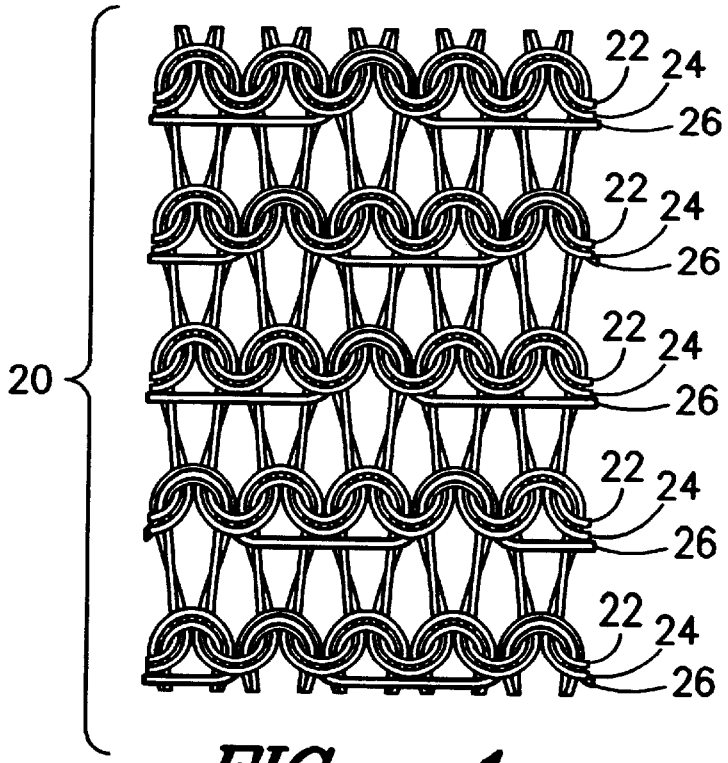
FIG. 1 is a top view of a portion of an inventive moldable circular knit fabric.

Turning now to the drawings wherein like reference numerals designate like components in the various views, in FIG. 1 there is shown a preferred heat-moldable inventive fabric 20 is shown which comprises three separate yarns 22, 24, 26 per stitch. The particularly preferred yarns are comprised of spandex 22, possessing a preferred denier of about 140, 2-ply 68 count polyester filament 24, possessing a preferred denier of about 70, and a single 68 count polyester filament float yarn 26, also having a denier of about 70. The spandex yarns 22 are preferably incorporated as the top yarn within each repeating stitch pattern in order to provide greater power internally within each stitch. The float 26 is incorporated in order to provide the moldable characteristics as discussed at greater length above.

Figure 2:
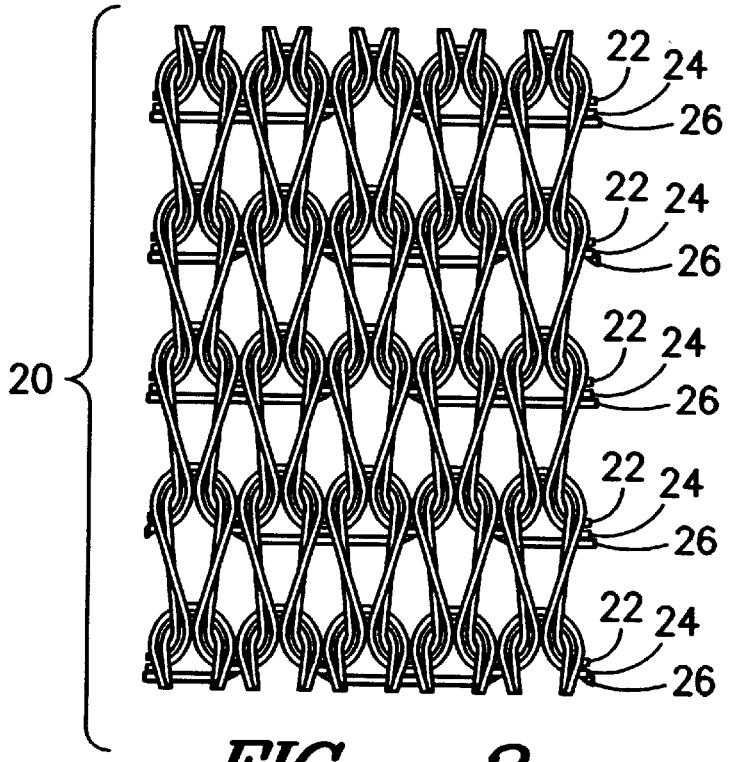
FIG. 2 is a rear view of the same inventive fabric of FIG. 1.

FIG. 2 represents the rear view of FIG. 1 and illustrates, again, the preferred stitch pattern within the fabric 20 wherein the spandex yarns 22 are present as the top yarns within each repeated stitch in order to supply the desired amount of power for both support and comfort to the wearer. The spandex yarns 20 was measured to comprise roughly 24% of the total weight of the fabric 10.

As these are merely preferred embodiments, the possible range of amounts of spandex yarns within the inventive fabrics may be as low as 24% of the total fiber content of the entire fabric structure. An upper limit of roughly 75% would present a limit as to constrictive power for utility within a proper, comfortable support garment. More preferably would be a spandex amount of between 24 and 50%.

There are, of course, many alternative embodiments and modifications of the present invention which are intended to be included within the spirit and scope of the following claims.

What I claim is:

1. A method of forming an opaque heat-moldable, circular knit fabric comprising spandex in an amount of at least 24% by weight of the fabric, said method comprising the steps of:

(a) providing at least one thread of spandex fiber and at least one non-spandexcontaining thread;

(b) delivering said threads to a needle bed under constant tension;

(c) feeding said threads into a needle bed while simultaneously elongating said spandex thread to 100% of its total stretch capability;

(d) introducing said elongated spandex thread and said non-spandex-containing thread within a carrier fabric comprising at least one fiber selected from the group consisting of polyamide, polyester, cotton, wool, ramie, acetate, polyurethane, and any blends thereof;

(e) pulling said threads into the loop construction of the resultant circular knit fabric; and (f) knitting at least one non-spandex-containing float per repeated knit pattern into the fabric structure; and, as an optional step, (g) incorporating the circular knit fabric into a garment.

2. The fabric of claim 1 wherein said at least one non-spandex-containing fiber is selected from the group consisting of polyamide, polyester, cotton, wool, ramie, acetate, polyurethane, and any blends thereof.

3. A support garment comprising the heat-moldable circular knit fabric of claim 1.

4. A support garment comprising the heat-moldable circular knit fabric of claim 2.

5. The fabric of claim 1 wherein said spandex fiber comprises from about 24 to about 75% by weight of the fabric.

6. The fabric of claim 5 wherein said spandex fiber comprises from about 24% to about 50% by weight of the fabric.

7. The fabric of claim 1 wherein said spandex fiber comprises from about 24% of the weight of the fabric.

8. The a method of forming an opaque heat-moldable, circular knit fabric comprising spandex in an amount of at least 24% by weight of the fabric, said method comprising the steps of:

(a) providing at least one thread of spandex fiber and at least one non-spandexcontaining thread;

(b) delivering said threads to a needle bed under constant tension;

(c) feeding said threads into a needle bed while simultaneously elongating said spandex thread to 100% of its total stretch capability;

(d) introducing said elongated spandex thread and said non-spandex-containing thread within a carrier fabric comprising at least one fiber selected from the group consisting of polyamide, polyester, cotton, wool, ramie, acetate, polyurethane, and any blends thereof;

(e) pulling said threads into the loop construction of the resultant circular knit fabric; and (f) knitting at least one non-spandex-containing float per repeated knit pattern into the fabric structure; and, as optional steps, (g) incorporating the circular knit fabric into a garment;

(h) fitting the support garment of step "g" to at least a portion of a person's body; and (i) heat-setting the garment in the position in which the garment is oriented during step "h".

9. A heat-moldable circular knit fabric formed through the method of claim 8.

10. A support garment comprising the fabric of claim 9.

11. The method of claim 8 wherein said spandex fiber comprises from about 24 to about 75% of the weight of the fabric.

12. The method of claim 11 wherein said spandex fiber comprises from about 24% to about 50% of the weight of the fabric.

13. The method of claim 12 wherein said spandex fiber comprises about 24% of the weight of the fabric.

* * * * *

UNITED STATES PATENT AND TRADEMARK OFFICE

CERTIFICATE OF CORRECTION

PATENT NO. : 6,263,707 B1
DATED : July 24, 2001
INVENTOR(S) : James Martin Miller et al.

It is certified that error appears in the above-identified patent and that said Letters Patent is hereby corrected as shown below:

Column 7,
Line 32, should read:

-- 1. An opaque heat-moldable circular knit fabric comprising at least two different types of fibers, one being spandex and the other at least one non-spandex-containing fiber, wherein the total amount present within said fabric of spandex fiber is at least 24% of the total fiber weight of the entire fabric, and wherein at least one non-spandex-containing float per repeated knit pattern is present within the knit fabric. --

Signed and Sealed this

Thirteenth Day of August, 2002

*Attest:*

*Attesting Officer*

JAMES E. ROGAN
*Director of the United States Patent and Trademark Office*